US011411362B2

(12) United States Patent
Phillips

(10) Patent No.: US 11,411,362 B2
(45) Date of Patent: Aug. 9, 2022

(54) COMPRESSION TOOL WITH REVERSIBLE BLOCK

(71) Applicant: Ripley Tools, LLC, Cleveland, OH (US)

(72) Inventor: Paul Phillips, Middlebury, CT (US)

(73) Assignee: Ripley Tools, LLC, Cleveland, OH (US)

( * ) Notice: Subject to any disclaimer, the term of this patent is extended or adjusted under 35 U.S.C. 154(b) by 640 days.

(21) Appl. No.: 16/121,185

(22) Filed: Sep. 4, 2018

(65) Prior Publication Data

US 2018/0375277 A1 Dec. 27, 2018

Related U.S. Application Data

(62) Division of application No. 14/873,912, filed on Oct. 2, 2015, now Pat. No. 10,074,950.
(Continued)

(51) Int. Cl.
*H01R 43/042* (2006.01)
*H01R 43/045* (2006.01)
(Continued)

(52) U.S. Cl.
CPC ..... *H01R 43/042* (2013.01); *B25B 27/10* (2013.01); *H01R 43/015* (2013.01);
(Continued)

(58) Field of Classification Search
CPC ..... H01R 43/042; H01R 43/0424; H01R 43/0425; H01R 43/045; H01R 43/015;
(Continued)

(56) References Cited

U.S. PATENT DOCUMENTS 4,286,381 A * 9/1981 Litehizer, Jr. ..... H01R 43/015 29/751
2006/0021216 A1 2/2006 Islam
(Continued)

FOREIGN PATENT DOCUMENTS

JP 0200904322 A 2/2009
JP 2009140769 A * 6/2009

OTHER PUBLICATIONS

M. M. M. Ruzlin, A. H. H. Shafi and A. G. A. Basri, "Study of cable crimping factors affecting contact resistance of medium voltage cable ferrule and lug," 22nd International Conference and Exhibition on Electricity Distribution (CIRED 2013), 2013, pp. 1-4, doi: 10.1049/cp.2013.1038. (Year: 2013).*

*Primary Examiner* — A. Dexter Tugbang
(74) *Attorney, Agent, or Firm* — Delio Peterson & Curcio LLC; Peter W. Peterson

(57) ABSTRACT

A compression tool for fastening a cable to a connector comprising an elongated tool frame, an anvil secured to one end of the tool frame, a compression plunger slidable along a portion of the tool frame, a handle set adapted to move the compression plunger toward and away from the anvil and a spacer block for securing the connector a distance from the anvil. The handle set may include a first handle movable from a first position wherein the plunger is a first distance from the anvil to a second position wherein the plunger is a second distance from the anvil. The spacer block may include a first end and a second end having a different depth from the first end and be rotatable so that the first end when rotated to the active position secures the connector a first distance from the anvil and the second end, when rotated to the active position secures the connector a second distance from the anvil.

8 Claims, 5 Drawing Sheets

Related U.S. Application Data

(60) Provisional application No. 62/059,346, filed on Oct. 3, 2014.

(51) Int. Cl.
*B25B 27/10* (2006.01)
*H01R 43/01* (2006.01)

(52) U.S. Cl.
CPC ..... *H01R 43/045* (2013.01); *H01R 43/0424* (2013.01); *H01R 43/0425* (2013.01); *Y10T 29/5323* (2015.01); *Y10T 29/53222* (2015.01); *Y10T 29/53226* (2015.01); *Y10T 29/53952* (2015.01); *Y10T 29/53987* (2015.01)

(58) Field of Classification Search
CPC ..... B25B 27/10; Y10T 29/53222; Y10T 29/53226; Y10T 29/5323; Y10T 29/53952; Y10T 29/53987
See application file for complete search history.

(56) References Cited

U.S. PATENT DOCUMENTS

| | | | | |
|---|---|---|---|---|
| 2007/0234556 | A1* | 10/2007 | Montena ..... | H01R 43/042 29/747 |
| 2008/0189936 | A1* | 8/2008 | Sutter ..... | Y10T 29/53222 29/747 |
| 2011/0154651 | A1 | 6/2011 | Liu | |

* cited by examiner

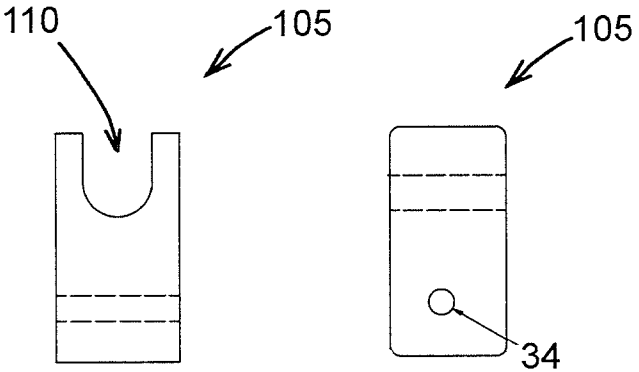
FIG. 14
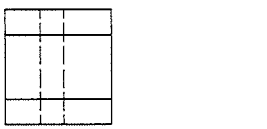
FIG. 15
FIG. 13
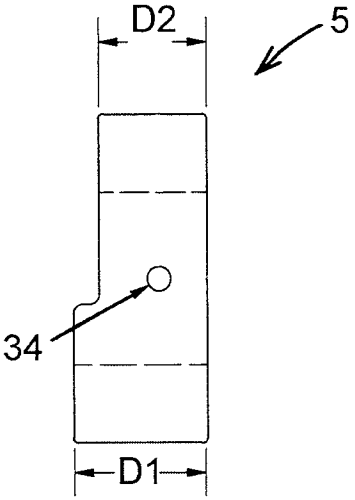
FIG. 11
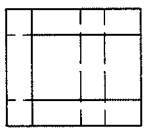
FIG. 12
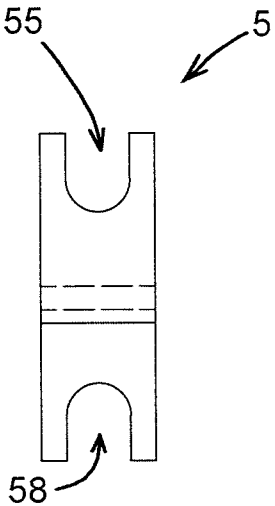
FIG. 10

COMPRESSION TOOL WITH REVERSIBLE BLOCK

BACKGROUND OF THE INVENTION

Field of the Invention

The present invention relates to compression tools for securing a cable to a connecter and more specifically a compression tool which may be used with different sized connectors.

SUMMARY OF THE INVENTION

Bearing in mind the problems and deficiencies of the prior art, it is therefore an object of the present invention to provide a compression tool which allows a cable to be connected to various sized connectors.

Still other objects and advantages of the invention will in part be obvious and will in part be apparent from the specification.

The above and other objects, which will be apparent to those skilled in the art, are achieved in the present invention which is directed to a compression tool for fastening a cable to a connector comprising an elongated tool frame, an anvil secured to one end of the tool frame, a compression plunger slidable along a portion of the tool frame, a handle set adapted to move the compression plunger toward and away from the anvil and a spacer block for securing the connector a distance from the anvil. The handle set may include a first handle and a second handle, the first and second handle movable from a first position wherein the plunger is a first distance from the anvil to a second position wherein the plunger is a second distance from the anvil, the second distance being less than the first distance. The spacer block may include a first end and a second end having a different depth from the first end, the spacer block rotatable so that the first end when rotated to the active position secures the connector a first distance from the anvil and the second end, when rotated to the active position secures the connector a second distance from the anvil, different than the first distance from the anvil end. The compression tool may include at least one magnet secured to the anvil for securing the spacer block to the anvil when the spacer block is in one of the active positions.

Another aspect of the invention is directed to a method for using a compression tool comprising providing a compression tool having a compression plunger, a handle set for transmitting force to the compression plunger, and anvil secured to one end of the compression tool and a spacer block for securing the connector a distance from the anvil, the spacer black usable in three different positions. The method includes providing a connector and a cable end for attaching to the connector, ensuring the compression tool is in the open position, selecting one of the three positions for the spacer block, placing the cable end inside the connector, securing the connecter and cable against the spacer block, moving the compression tool to the closed position, moving the compression tool to the open position and removing the cable and connector from the compression tool.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 10 is a front view of the reversible spacer block according to the present invention.

FIG. 11 is a side view of the reversible spacer block shown in FIG. 10.

FIG. 12 is a top view of the reversible spacer block shown in FIG. 10.

FIG. 13 is a front view of a single position spacer block according to the present invention.

FIG. 14 is a side view of the spacer block shown in FIG. 13.

FIG. 15 is a top view of the spacer block shown in FIG. 13.

DESCRIPTION OF THE PREFERRED EMBODIMENT(S)

In describing the preferred embodiment of the present invention, reference will be made herein to FIGS. 1-15 of the drawings in which like numerals refer to like features of the invention.

Figure 1:
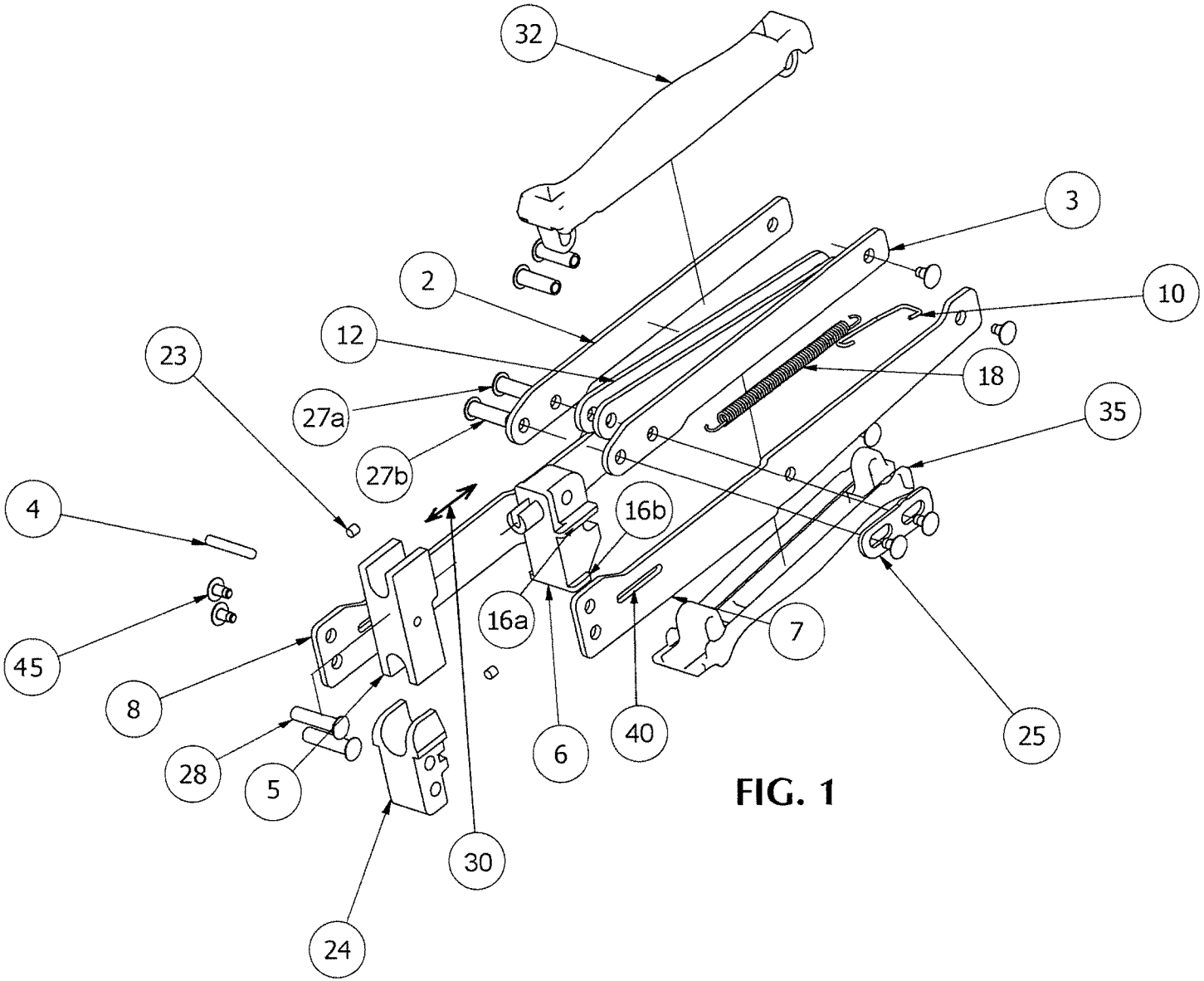
FIG. 1 is an exploded view of the compression tool according to the present invention.
Figure 2:
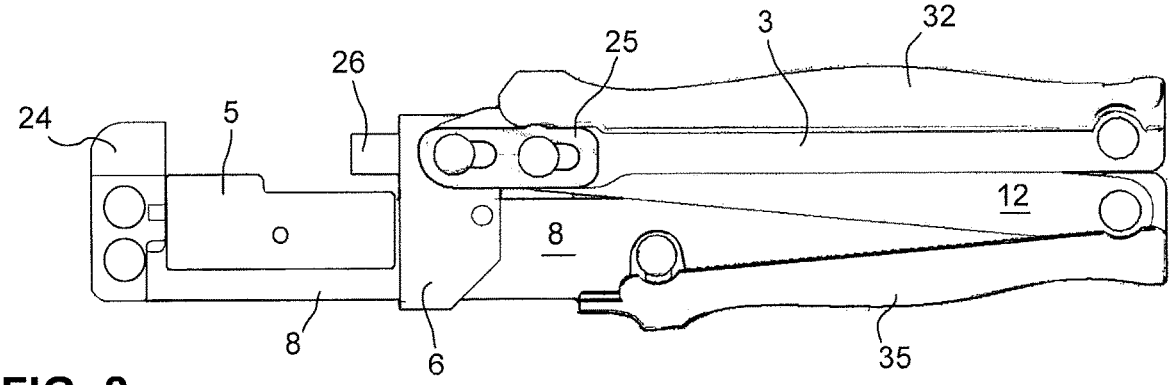
FIG. 2 is a side view of the compression tool shown in FIG. 1 in the closed position with the spacer block in an inactive position, the left side frame member removed for clarity.
Figure 3:
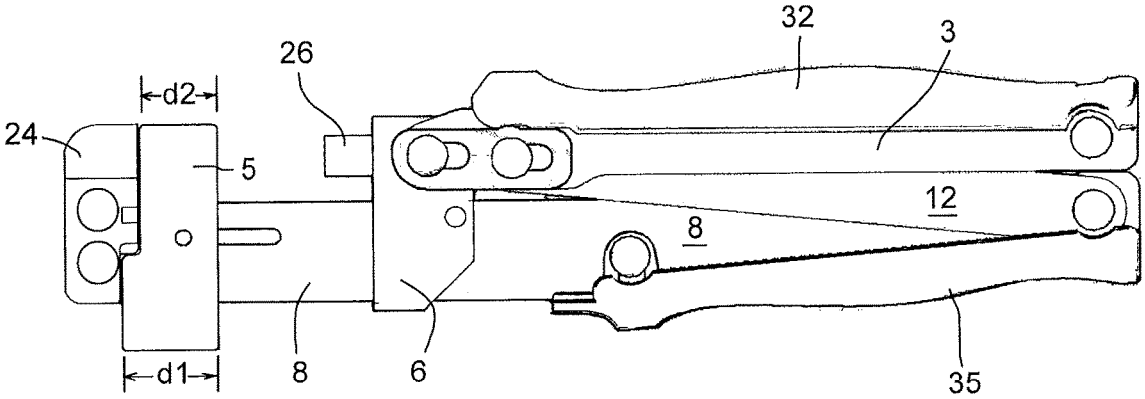
FIG. 3 is a side view of the compression tool shown in FIG. 1 in the closed position with the spacer block in a first active position, the left side frame member removed for clarity.
Figure 4:
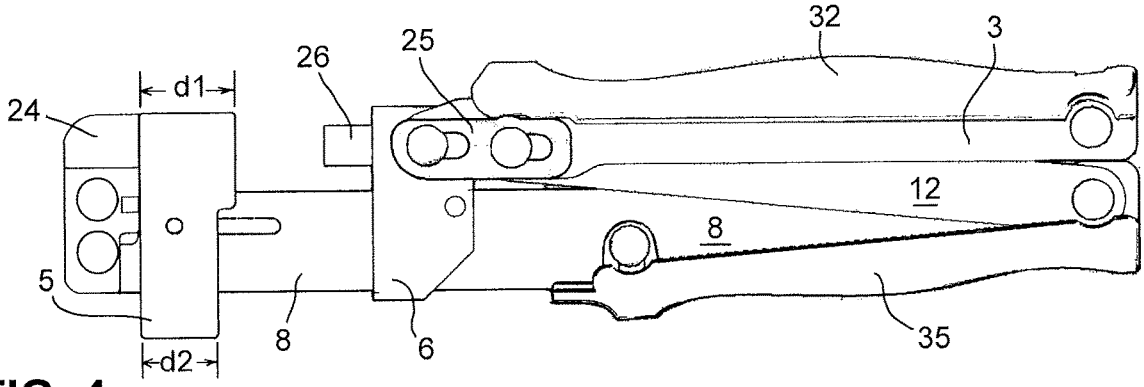
FIG. 4 is a side view of the compression tool shown in FIG. 1 in the closed position with the spacer block in a second active position, the left side frame member removed for clarity.
Figure 5:
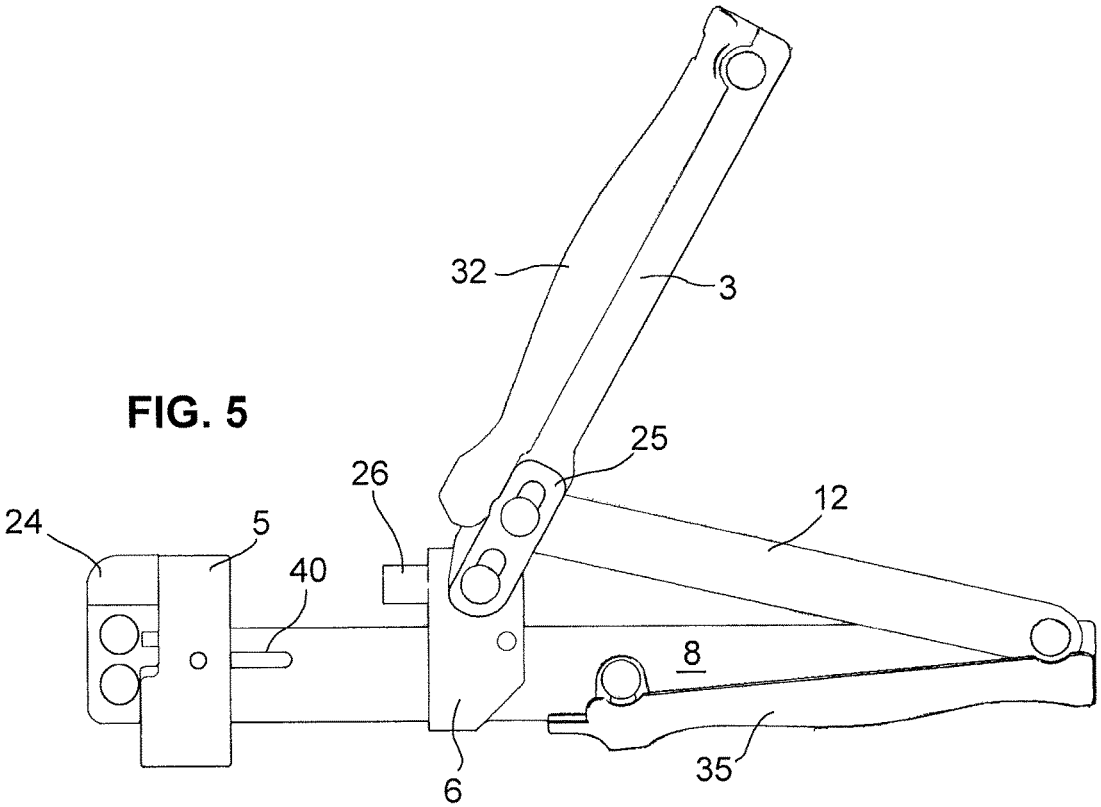
FIG. 5 is a side view of the compression tool shown in FIG. 1 in the open position with the spacer block in a first active position, the left side frame member removed for clarity.
Figure 6:
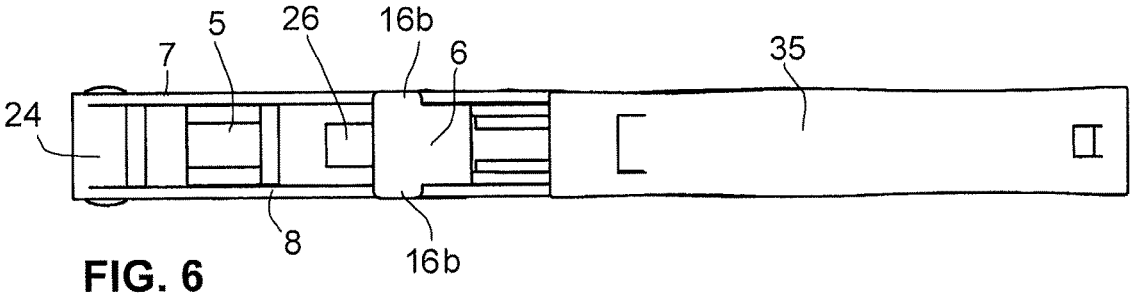
FIG. 6 is a bottom view of the compression tool shown in FIG. 1 in the closed position.
Figure 7:
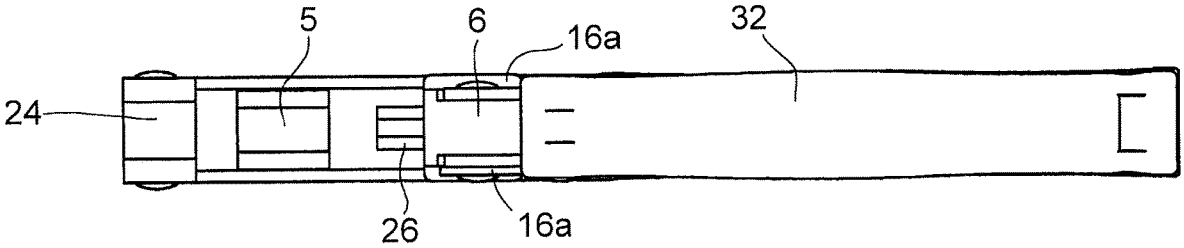
FIG. 7 is a top view of the compression tool shown in FIG. 1 in the closed position.
Figure 9:
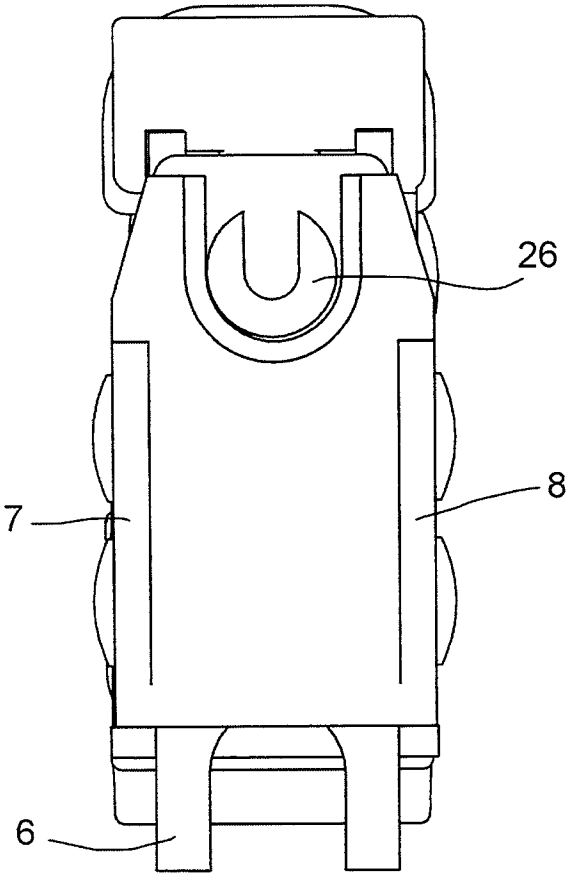
FIG. 9 is a front view of the compression tool shown in FIG. 1 in the closed position.
Figure 8:
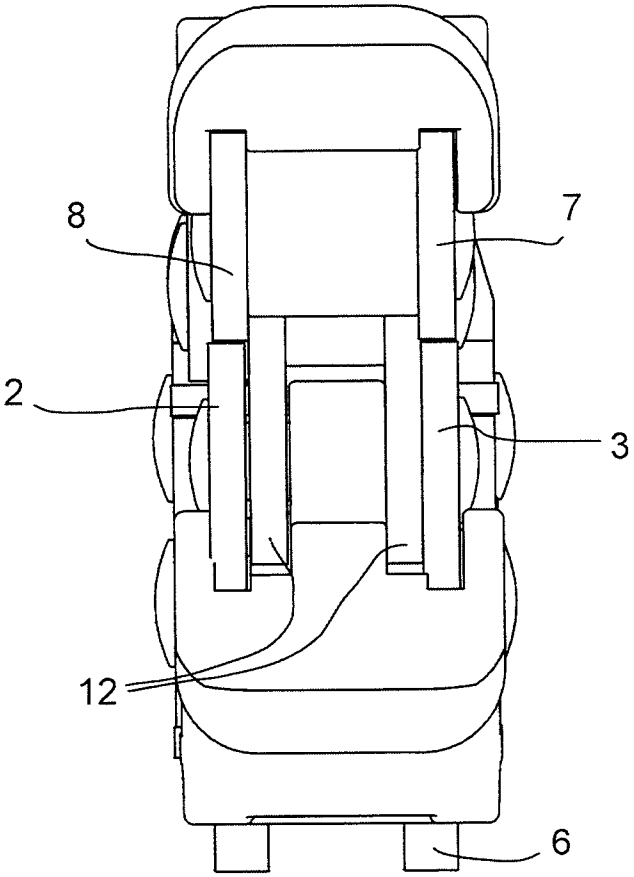
FIG. 8 is a rear view of the compression tool shown in FIG. 1 in the closed position.

The compression tool 20 as shown in FIGS. 1-9 includes a left frame member 7, a right frame member 8 and a plunger block 6 slidable along the left and right frame members 7, 8 by an upper and lower guide 16*a*,16*b* extending from each side of the plunger block 6. The left and right frame members 7, 8 have a length extending in the direction of arrow 30. The upper and lower guides engage the left and right frame members and allow the plunger block to slide lengthwise along the left and right frame members in the direction of arrow 30. An anvil 24 is secured to a first end of the left and right frame members with fasteners 28. The fasteners 28 may include a fastener cap 45. A left handle 3 and a right handle 2 are secured at one end to the plunger block 6 and a central portion of the left and right frame members so that rotation of the left and right handles about fastener 27*a* through the left and right frame members moves the plunger block in a forward or rearward direction along the left and right frame members. The plunger block is attached to the left and right handles with fastener 27*b*. The plunger block 6 includes a cylindrical plunger 26 extending toward the anvil. Referring to FIGS. 4 and 5, moving the left and right handles from an open position where the second end of the left and right handles are extended outwardly from the frame members 7, 8 to a closed position where the second end of the left and right handles are extended inwardly toward the frame members 7, 8 slides the plunger block from a position away from the anvil to a position toward the anvil. A pair of linking members 12 are pivotally secured to and extend from one end of the left and right frame members opposite the end of the left and right frame members having the anvil to the end of the left and right handles which are secured to the plunger block. Handle cover or grip 32 is attached to handles 2, 3. Handle grip 35 is attached to the frame members 7, 8. Handle grips 32, 35 provide more comfortable use of the tool. A spring 18 and spring connector 10 bias the compression tool in the open position. A lock bar 25 is slidingly attached to the left and right handles, linking members 12 and plunger block 6 with fasteners 27*a*, 27*b* and slides from a first lock position whereby the handles are prevented from being moved to the open position to a second lock position whereby the handles may be moved to either the open or closed position.

The compression tool includes a reversible spacer block 5 as shown in FIGS. 10-12 for securing a connector a distance from the anvil. The spacer block includes a first end having a depth D1 and a second end having a different depth D2 and a groove on each end for the cable to pass through. The first end has depth D1 for securing a connector having a first length and the second end has a depth D2 for securing a connector having a second length different than the first length. The spacer block includes channels 55, 58 for accommodating the cable. The spacer block 5 is rotatable from an inactive position shown in FIG. 2 to a first active position shown in FIG. 3 and to a second active position shown in FIG. 4. The spacer block is rotatable about opening 34 through which pin 4 extends. Each position is for using the compression tool on a different length connector. The spacer block is rotatable about a pin 4 extending through an opening in the spacer block. The pin is slidable in elongated openings in the left and right frame members so the spacer block may be pulled away from the anvil during rotation. Magnets 23 are secured to the anvil and allow the spacer block to be magnetically secured to the anvil when the spacer block is in one of the three spacer block positions shown in FIGS. 2-4.

As shown in FIGS. 13-15, the compression tool may include a single position spacer block 105 rather than the reversible space block 5. The spacer depth D3 may be the same as D1 or D2. The depth D3 may alternately be a depth different than either D1 or D2. The single position spacer block 105 may still be reversible where the block channel 110 may be in the active position when the block 105 is aligned with the cylindrical plunger 26, and in the inactive position when the block 105 is rotated 180° from the active position. In the 180° rotated positon, no spacer is used in performing the compression of the connector. The spacer block 105 is rotatable about opening 34'.

The compression tool utilizes a toggle action to generate linear motion which compresses fittings against a fixed anvil positioned at the distal end of the device. The compression distance can be changed by utilizing a moveable spacer block (Secondary Anvil) which is pinned through the side walls of the tool. This spacer block (secondary anvil) is then positioned against the fixed anvil thereby changing the compression distance. This secondary anvil (Spacer Block) has 2 potential configurations: A 1-position spacer block (Shorter Style) and a 2-position spacer block (Taller Style with a stepped surface). Only 1 spacer block configuration can be pinned to a tool at a time. When the block is not being used, the block is rotated out of position and magnetically stored out of the way.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A compression tool for fastening a cable to a connector comprising:

an anvil secured to one end of the compression tool, the compression tool having a compression tool length;

a compression plunger slidable in a direction of the compression tool length;

a handle set for transmitting force to the compression plunger toward and away from the anvil; and a spacer block for securing the connector a distance from the anvil, the spacer block disposed against the anvil, the spacer block including a first spacer block end having a first depth in the direction of the compression tool length and a second spacer block end having a second depth different than the first depth wherein the spacer block is rotatable about an axis perpendicular to the compression tool length to a first or second active position; wherein the first active position secures the connector a first distance from the anvil and the second active position secures the connector a second distance from the anvil, different than the first distance from the anvil; and wherein the spacer block includes a first spacer block end and a second spacer block end wherein the first and second spacer block ends each include a channel for accommodating and supporting the cable.

2. The compression tool of claim 1 including a spring for biasing the compression plunger away from the anvil.

3. The compression tool of claim 1 wherein the spacer block is rotatable about a pin extending through an opening in the spacer block, the pin slidable in an elongated opening along the compression tool length so the spacer block may be pulled away from the anvil during rotation.

4. A compression tool for fastening a cable to a connector comprising:

an anvil secured to one end of the compression tool, the compression tool having a compression tool length;

a compression plunger slidable in a direction of the compression tool length;

a handle set for transmitting force to the compression plunger toward and away from the anvil;

a spacer block for securing the connector a distance from the anvil, the spacer block disposed against the anvil, the spacer block including a first spacer block end having a first depth in the direction of the compression tool length and a second spacer block end having a second depth different than the first depth wherein the spacer block is rotatable about an axis perpendicular to the compression tool length to a first or second active position; and at least one magnet secured to the anvil for securing the spacer block to the anvil when the spacer block is in the first or second active position;

wherein the first active position secures the connector a first distance from the anvil and the second active position secures the connector a second distance from the anvil, different than the first distance from the anvil.

5. The compression tool of claim 4 wherein the handle set includes a handle and a linking member, the handle and linking member movable from an open position wherein the plunger is a first distance from the anvil to a closed position wherein the plunger is a second distance from the anvil, the second distance being less than the first distance.

6. The compression tool of claim 4 wherein the spacer block may be rotated to a third inactive position between the first active position and the second active position.

7. A compression tool for fastening a cable to a connector comprising:

an anvil secured to one end of the compression tool, the compression tool having a compression tool length;

a compression plunger slidable in a direction of the compression tool length;

a handle set for transmitting force to the compression plunger toward and away from the anvil; and a spacer block for securing the connector a distance from the anvil, the spacer block disposed against the anvil, the spacer block including a first spacer block end having a first depth in the direction of the compression tool length and a second spacer block end having a second depth different than the first depth wherein the spacer block is rotatable about an axis perpendicular to the compression tool length to a first or second active position;

wherein the handle set includes a handle and a linking member, the handle and linking member movable from an open position wherein the compression plunger is a first distance from the anvil to a closed position wherein the compression plunger is a second distance from the anvil, the second distance being less than the first distance; and wherein the elongated tool frame includes left and right frame members, the handle includes left and right handle members rotatably secured at one end to the compression plunger and the linking member includes right and left linking members pivotally secured to and extending from one end of the left and right frame members opposite the end of the left and right frame members having the anvil.

8. The compression tool of claim 7 including a lock bar slidingly attached to the left and right handle members, left and right linking members and plunger with fasteners, the lock bar slidable from a first lock position whereby the left and right handle members are prevented from being moved to the open position to a second lock position whereby the right and left handle members may be moved to either the open or closed position.

* * * * *